United States Patent [19]

Ash et al.

[11] Patent Number: 4,748,958

[45] **Date of Patent: * Jun. 7, 1988**

[54] METHOD AND MEANS FOR REPAIRING INJECTION FUEL PUMP PISTONS

[76] Inventors: Eugene G. Ash, 1406 121st St. Rte. 2, Hopkins, Mich. 49328; Martin J. Tompkins, Jr., 2430 Veltema, Holt, Mich. 48842

[ * ] Notice: The portion of the term of this patent subsequent to Jun. 17, 2003 has been disclaimed.

[21] Appl. No.: 929,505

[22] Filed: Nov. 12, 1986

[51] Int. Cl.[4] ..... F02M 39/00

[52] U.S. Cl. ..... 123/502; 123/449; 29/402.04

[58] Field of Search ..... 123/502, 501, 500, 449; 29/402.09, 156.4 WL, 156.5 R, 402.02, 402.06, 402.07, 402.03, 402.04, 402.05

[56] References Cited

U.S. PATENT DOCUMENTS

| | | | |
|---|---|---|---|
| 4,037,574 | 7/1977 | Swift | 123/502 |
| 4,041,919 | 8/1977 | Ponin | 123/502 |
| 4,224,916 | 9/1980 | Davis | 123/502 |
| 4,227,292 | 10/1980 | Kipling | 29/402.04 |
| 4,355,621 | 10/1982 | Yasuhara | 123/502 |
| 4,453,522 | 6/1984 | Salzgeber | 123/502 |
| 4,457,284 | 7/1984 | Salzgeber | 123/502 |
| 4,538,581 | 9/1985 | Hakansson | 123/502 |
| 4,594,988 | 6/1986 | Tompkins | 123/502 |

*Primary Examiner*—Carl Stuart Miller

*Attorney, Agent, or Firm*—Price, Heneveld, Cooper, DeWitt & Litton

[57] ABSTRACT

The repair of a work timing piston for a rotary fuel injection pump having a cast aluminum cylinder for the piston and a steel piston is accomplished by reducing the diameter of the piston and jacketing it with an aluminum sleeve which has been hard coat anodized to eliminate galling.

5 Claims, 2 Drawing Sheets

METHOD AND MEANS FOR REPAIRING INJECTION FUEL PUMP PISTONS

FIELD OF THE INVENTION

This invention relates to the repair or rebuilding of the timing piston of rotary fuel injection pumps and is an improvement on the method and means of accomplishing this disclosed in our U.S. Pat. No. 4,594,988 issued June 17, 1986, entitled METHOD FOR BUILDING OR REPAIRING ROTARY INJECTION FUEL PUMP PISTON CYLINDERS.

BACKGROUND OF THE INVENTION

Thc conditions which give rise to the necessity for repair of fuel injection pumps are discussed at length in U.S. Pat. No. 4,594,988 and such conditions are equally applicable to this invention. Basically, the necessity arises from the fact that the pumps include a reciprocating piston of a relatively hard material such as steel mounted in a cylinder of a relatively soft material such as aluminum. The fuel injection pump operates at high speed which contributes to wear. Since the accurate and effective operation of these pumps has a very significant effect upon the performance of the engine, it is essential that they be repaired as soon as any significant wear occurs.

The repair method and means disclosed in our U.S. Pat. No. 4,594,988, while effective both for restoring the fuel injection pump's accuracy and efficiency as well as substantially increasing its life, does involve complex machining of the pump housing. This must be carefully done both from the standpoint of accuracy and because the wall thickness remaining after the machining in a significant is critical in a number of cases. Further, because of this such a repair normally can only be done once, there remaining insufficient wall thickness on the pump housing to permit a second machining.

BRIEF DESCRIPTION OF THE INVENTION

This invention eliminates the problems of performing the primary repair work on the pump housing by doing it on the piston. The machining on the housing is limited to honing the housing to remove any stria or eccentricity resulting from wear. The major precision repair work is performed on the piston by machining and resurfacing it to receive a sleeve, the surface of which can be machined to very precise dimensions.

DESCRIPTION OF THE PREFERRED EMBODIMENT

The following description of the pump is from U.S. Pat. No. 4,594,988 and provides the setting for the present invention.

Figure 3:
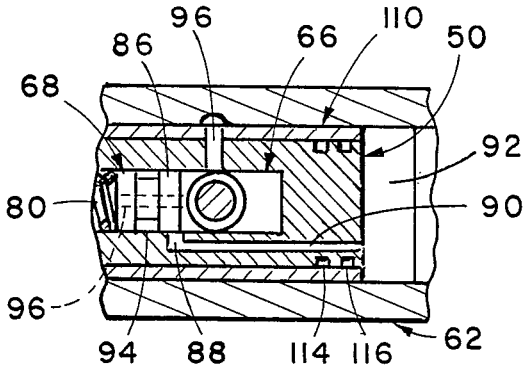
FIG. 3 is a fragmentary sectional view taken along the plane III—III of FIG. 2.

With reference to FIG. 3, a rotary fuel injection pump of the type commercially used for supplying discrete, measured charges of liquid fuel to an associated compression-ignition engine is disclosed. The pump includes a housing 10 and a distributor rotor 12 journaled in a bore of a fuel distributor sleeve 14 which is sealed within a bore of a hydraulic distributor head 16 mounted within the pump housing 10.

Mounted at one end of the rotor 12 for rotation therewith is a low pressure vane type transfer pump 20 having an inlet 22 to which fuel is supplied from a supply tank (not shown). The outlet of the transfer pump 20 is connected to an annulus 25 in the hydraulic distributor head 16 by a passage 24.

The rotor 12 is shown as having a pair of fuel inlet passages 28 and fuel discharge passage 30. As the rotor 12 turns, the inlet passages 28 of the rotor 12 register sequentially with a plurality of radial ports 32 (only two of which are shown) uniformly spaced around the distributor sleeve 14 in a plane of rotation of the inlet passages 28 to provide periodic communication between the annulus 34 and an inlet passage 28 for supplying fuel to the rotor 12. The discharge passage 30 similarly communicates sequentially with a plurality of passages 36 (only one of which is shown). Passages 36 are uniformly spaced around the distributor sleeve 14 in the plane of rotation for the discharge passage 30 as the rotor 12 turns to sequentially deliver pressurized fuel charges from the rotor to a plurality of fuel connectors 36 for delivery of the fuel charges to the cylinders of an associated engine (not shown). A delivery valve 40 located in an axial passage 41 in the rotor 12 controls the backflow of pressurized fuel from the discharge passage 30.

The rotor 12 has an enlarged generally cylindrical portion with a diametrical bore which mounts a pair of diametrically opposed plungers 42 for reciprocation therein. The space between the inner ends of the plungers 42 forms a high pressure pump chamber 44 connected to the inlet passages 28 and the discharge passage 30 by axial passage 41 to alternately receive and discharge fuel as the rotor 12 turns.

Surrounding the plungers 42 in their plane of revolution and around the longitudinal axis of the rotor 12 is a generally circular cam ring 46. The cam ring 46 is mounted in a bore 48 of the housing 10 for limited angular movement and its angular position is controlled by a timing piston 50 operatively connected thereto by a connector 52.

The cam ring 46 has an inner annular cam surface with a plurality of inwardly projecting cam lobes 54 which are positioned to simultaneously actuate the diametrically opposed plungers 42 inwardly. For that purpose, a roller assembly comprising a roller 56 and a roller shoe 58 is disposed between each plunger 42 and the cam ring 46 so that the rollers 56 act as cam followers for translating the cam contour into reciprocal movement of the opposed plungers 42.

In operation, as the rotor 12 is driven by the engine through drive shaft 60, low pressure fuel from the transfer pump 20 is delivered through one of the ports 32 to a rotor inlet passage 28 to the pump chamber 44, it being understood that opposed rollers 56 are angularly disposed with respect to the cam lobes 54 of the cam ring 46 to permit the plungers 42 to move radially outwardly in synchronism with registry of an inlet passage 28 with each port 32 so that fuel can enter chamber 44. As the rotor 12 continues to turn, the inlet passage 28 moves out of registry with the port 32 and the plunger actuating rollers 56 roll up leading surfaces of a pair of cam lobe 54 to force the plungers 42 inwardly and pressurize a charge of fuel in the pump chamber 44 to a high pressure. At this time the discharge passage 30 has moved into registry with a delivery passage 36 connected to one of the cylinders of the engine for injection of a charge of fuel thereto under high pressure. Continued rotation of the rotor 12 repeats the process for sequential delivery of a charge of fuel to each cylinder of an associate engine in timed relation therewith.

Figure 4:
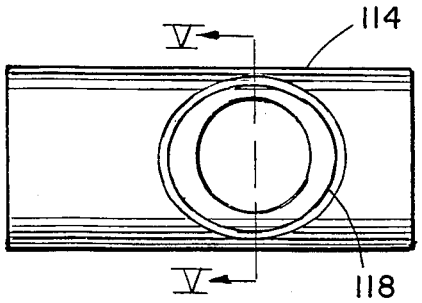
FIG. 4 is a plan view of the repaired piston.
Figure 5:
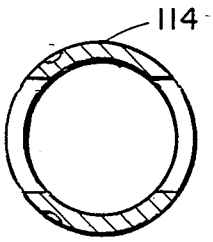
FIG. 5 is a sectional view taken along the plane V—V of FIG. 4.

With reference to FIG. 4, cam ring 46 is mounted so that it can be angularly adjusted to control the timing of the pumping strokes of plungers 42. The pumping strokes can be adjusted to occur slightly sooner (advanced) or slightly later (retarded) as the drive shaft 60 is rotated. Connector 52 provides means for rotatably shifting the cam ring 46 to adjust the timing.

Connector 52 is driven by a timing piston 50 which is received in a cylinder 62 of the housing 10. Cylinder 62 extends tangentially to and in substantially the same plane as cam ring 46. Piston 50 connects with connector 52 so that the upper portion of connector 52, which interacts with cam ring 46, is movable longitudinally with respect to cylinder 62. It is the movement of the piston 50 which causes the wear on the walls of the cylinder 62.

Figure 1:
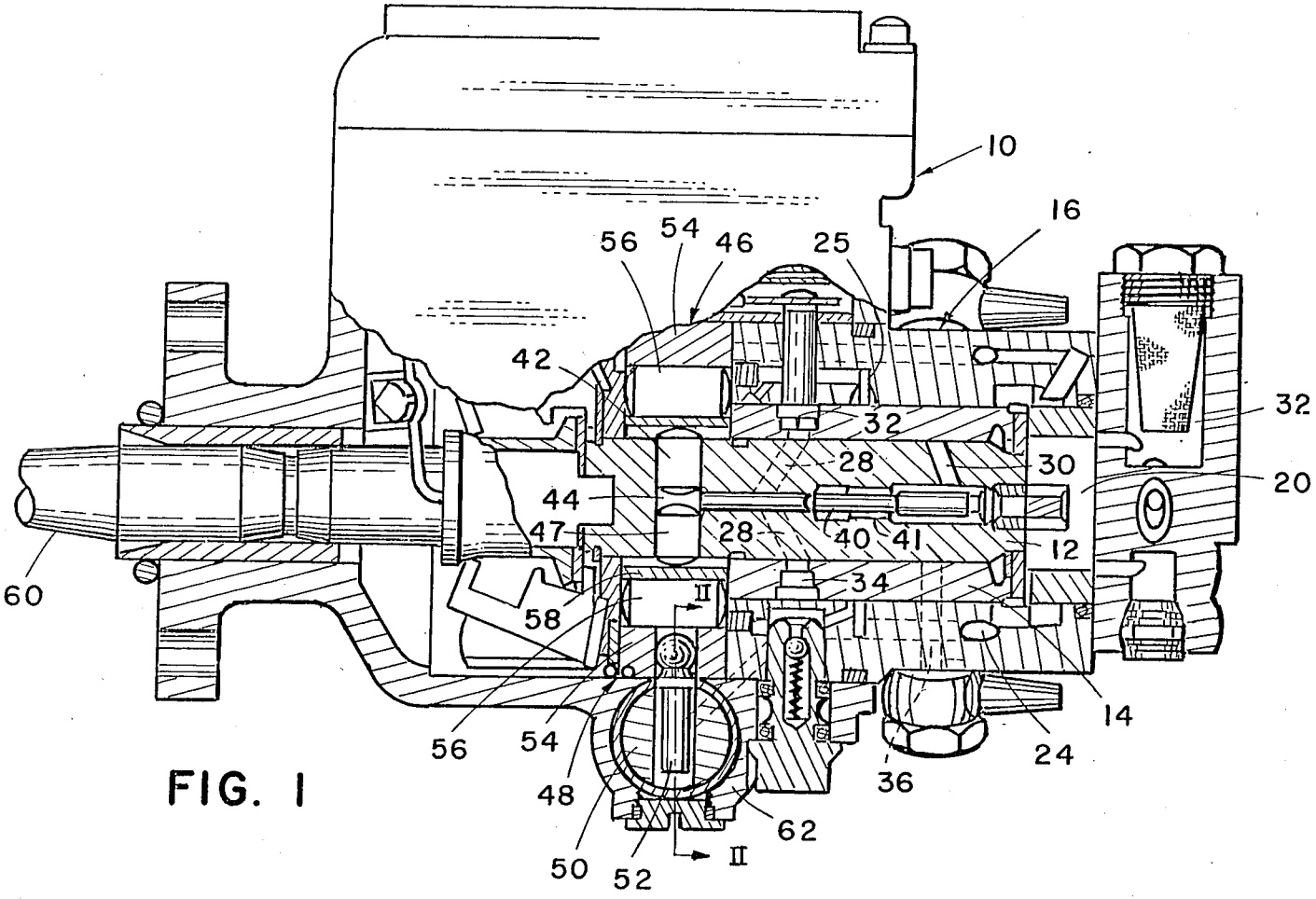
FIG. 1 is a side elevation of the fuel injection pump assembly partially broken and in section.
Figure 2:
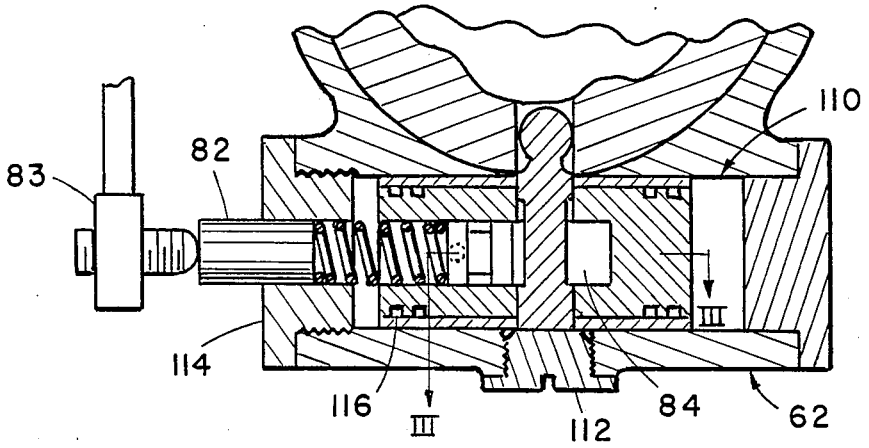
FIG. 2 is an enlarged fragmentary sectional view taken along the plane II—II of FIG. 1.

Piston 50 further provides an axial bore 66 in which a servo valve 68 is slidably received (FIG. 3). A servo biasing spring 80 engages one end of servo valve 68 to bias the servo valve 68 to the right as illustrated in FIGS. 2 and 3. The opposite end of spring 80 engages a spring seat 82 which is received in the left end of cylinder 62.

The longitudinal position of spring seat 82 relative to cylinder 62 may be varied to produce an increase or decrease in the bias exerted by spring 80 on servo valve 68. In a preferred embodiment, spring seat 82 is longitudinally moved in response to a lever arm 83 which is mechanically actuated by an increase in engine load such as the timing control for fuel injection pump disclosed in U.S. Pat. No. 4,224,916.

In operation, regulated transfer pump output pressure is continuously present in valve chamber 84 defined in piston bore 66 by the end of servo valve 68. The pressure in valve chamber 84 exerts a force on servo valve 68 in opposition to the biasing force of servo spring 80. Because the output pressure of the transfer pump is a function of engine speed, the position of servo valve 68 is dependent on engine speed.

As the engine speed increases, the pressure in valve chamber 84 increases to compress spring 80 so that the lead end 86 of the servo valve 68 uncovers port 88 of passage 90 and fuel passes from chamber 84 into chamber 92 as defined between piston 50 and the right end of cylinder 62, as illustrated in FIG. 3. As the quantity of fuel in chamber 92 increases, timing piston 50 is forced to the left as shown in FIG. 3 until lead 86 covers port 88 of passage 90 to terminate the flow of fuel between chambers 84 and 92. The termination of the fuel flow from chamber 84 to 92, determines an equilibrium position of piston 50 which in turn, acting through connector 52, fixes the angular position of cam ring 46 and consequently the timing of injection of fuel into the cylinder of the engine.

Upon the decrease of engine speed, the pressure in chamber 84 decreases, resulting in spring 80 forcing servo valve 68 to the right to provide communication between passage 90 and annulus 94 so that fuel is dumped from chamber 92 through bore 96 which communicates with the interior of the pump housing 10, as will be described below, until an equilibrium position of timing control piston 50 is attained.

The foregoing described operation of timing piston 50 essentially provides a means for adjusting the timing to correspond to engine speed, and with respect to the adjustment of spring seat 82, to adjust timing piston 50 in relation to increase or decrease in engine load. As illustrated in FIG. 4, the injection timing is advanced when timing piston 50 moves to the left. Timing is retarded as piston 50 moves to the right.

The wear which necessitates the repairs contemplated by this invention occurs to the inside surface 110 of the cylinder 62 of the housing 10 and results from the reciprocation of the piston 50. To make the repair, the plug 112 is removed and the connector 52 is removed through the resulting opening. After removal of the gland nut 114 the piston 50 can then be removed from the cylinder 62. The inside surface 110 of the cylinder 62 can then be machined by appropriate equipment such as by honing to remove the wear which has resulted from the operation of the piston 50. All of the wear will occur on the inside surface 110 because of the difference in hardness between the steel piston 50 and the aluminum cylinder 62 prevents wear on the piston. The machining of the bore of the cylinder 62 can be done by any well equipped engine repair shop using a very fine reamer oversize for the original bore in the range of 0.002 to 0.008 of an inch. Preferably the reamer should be fine enough to produce a finish approaching that of a lap and should produce a resurfaced bore that is accurately concentric with the original axis of the bore.

The rebuilding of the piston 50 is a more sophisticated undertaking and requires the piston to be sent to a central facility having the necessary precision equipment to perform the work. Also, the piston normally is case hardened and thus, it is not capable of being precision machined by the type of tooling normally available in the conventional engine repair shop.

To make the repair, the piston 50 is machined to reduce its diameter from 0.7495 to 0.678±0.0005 of an inch to receive the cylindrical repair jacket 114. In addition, circumferential channels 116 are cut into the piston, preferably adjacent each end, and a generally circular one is cut around the opening 118 for connector 52. The circumferential channels 116 can be provided solely adjacent one end of the piston or preferably adjacent each end. These channels preferably have a width of 0.05 to 0.08 inch and a depth of 0.008 to 0.015 inch.

The jacket is cut from seamless aluminum tubing, the inside surface of which is machined to a diameter of 0.686±0.001 of an inch which is 0.00531−0.008 of an inch larger than the diameter of the piston after the latter has been machined. The outside diameter of the aluminum jacket is also machined to a diameter of 0.758–0.7575. The inside, outside and end surfaces are then hard coat anodized which results in 0.0015 inch thick surface coating adding 0.003 inch to the outside diameter and reducing the inside diameter by 0.003 inch. In addition the hard coat anodizing penetrates the original surface of the jacket about 0.0015 inch. This is an important aspect of this type of treatment.

To secure the jacket to the piston, the surface of the piston is coated with a thin layer of an anerobic adhesive such as Saf-T-Lok, a product of Saf-T-Lok chemical Corp. of Oak Brook, Ill. In the application of the adhesive the channels 116 and 118 are filled to provide a positive anchor. This type of adhesive is chemically stable in the presence of diesel fuel and gasoline and gasoline containing either methyl or ethyl alcohol. It is also stable at the temperatures at which this type of equipment operates. Because of the thinness of the jacket it is not practical to Rockwell the jacket to test the resulting hardness. However, industry generally accepts and agrees the relative harness of hard coat anodizing is 60 to 70 Rockwell (C scale) and the procedure is generally described in Kirk-Othmer (Third Edition) pages 309–310 (1981). A preferred process is referred to in the industry as Anolube (TM) by International Hardcoat of Detroit, Mich.

After the hard coat anodizing, the surface of the jacket is ground using an abrasive compound preferably of 1100 grit, and may be ground and lapped to a diameter of 0.7575±0.00005, producing a mirror-like finish which will provide a clearance between the jacketed piston and the machined surface of the bore of the cylinder bore of approximately 0.0005 of an inch. Preferably, the grinding of the exterior surface is done on a centerless grinder. Such a fit is operable because the fuel acts as a lubricant.

While it is an accepted fact that aluminum is not a desirable material for either surface in situations in which one of the surfaces must slide with respect to the other and that galling results from movement of two aluminum surfaces with respect to each other. However, it has been discovered that the application of hard coat anodizing to one of the two contacting aluminum surfaces effectively prevents the galling, at least in circumstances where liquid hydrocarbon fuels such as diesel or gasoline fuel are concerned which can form a film between the surfaces. While this effect is surprising and the basis of it is not understood, it is theorized that it results from the fact that there is a substantial difference in hardness between the two contacting surfaces, thereby making one of them the necessary sacrificial surface. The experience so far with this repair technique indicates that the effective operating life of the piston and cylinder after rebuilding using this invention not only substantially exceeds that of the original steel piston in a cast aluminum cylinder, it also generally approaches that of the steel piston in an aluminum sleeve the inside surface of which has been hard coat anodized as taught in our U.S. Pat. No. 4,594,988. This invention was conceived as a result of trying to reduce the cost of repairing the fuel injection pump by eliminating the necessity for performing the precision machining on the fuel injection pump assembly itself, as is required by our invention set out in U.S. Pat. No. 4,594,988, making it necessary to ship the casting, i.e. the whole assembly housing, to a central repair service. Because of the weight and bulk of the casting, this is expensive. By utilizing this invention, only the pistons have to be shipped to the central repair facility. Experience with fuel injection pumps which have been repaired in accordance with the teachings of this invention have proven the technique to produce a significantly longer repair life than heretofore thought possible.

It has also been noted in those fuel injection pumps which have been repaired in accordance with this invention, and for one reason or another have had to be disassembled after substantial service, that the inside surface 110 of the cylinder exhibits very little wear. This is important because this surface, having once been machined to remove wear occasioned by the original equipment, cannot be remachined because such additional removal of material from the casting would eliminate the threading 130 and necessitate the replacement of the closure cap 114 and the closure cap at the opposite end of the cylinder 62. This would greatly add to the cost of the repair in both parts and labor. Further, this would add to the size of both the chamber 92 and the piston thereby increasing the total mass of both the piston and fuel which has to be moved. This would require replacement of the spring 80 to maintain proper operation of the servo value 68, further complicating the repair.

Another advantage of this invention is the fact that by rebuilding the pistons in a central facility which can afford to provide the type of precision equipment necessary to properly rebuild the piston, the pistons can all be rebuilt to consistently precise tolerances, permitting almost all of the permissible tolerance variance to be allocated to the remachining of the cylinder bore. This makes it possible to leave the remachining of the cylinder to the equipment in the field, that being the equipment normally available in a well equipped, engine rebuild facility.

Having described the invention and a preferred manner in which it can be carried out, it will be understood that various modifications can be made without departing from the principle of the invention. Such modifications are to be considered as included in the hereinafter appended claims unless these claims, by their language, expressly state otherwise.

I claim:

1. The improvement in timing pistons for rotary fuel injection pumps of the type having a die cast aluminum housing, said housing having a cylindrical chamber, a steel piston, said piston being received in said chamber, means for reciprocating said piston lengthwise of said chamber, an aluminum jacket surrounding said piston and extending the full length thereof, said jacket being rigidly secured to said piston; said jacket having an exterior surface hard coat anodized to a hardness of about 60–70 Rockwell (C scale) as the means of preventing galling due to the reciprocal movement of the aluminum jacketed piston within the aluminum chamber.

2. The improvement in timing pistons for rotary fuel injection pumps as described in claim 1 wherein said jacket has a wall thickness of approximately 0.0386 inch after hard coat anodizing and a ground and lapped finish surface having a diameter of 0.7574±0.00005 of an inch.

3. The improvement in timing pistons for rotary fuel injection pump as described in claim 3 wherein said jacket is bonded to said piston.

4. The method of repairing a worn timing piston for a rotary fuel injection pump having a cast aluminum housing incorporating a cylindrical pump chamber and a steel piston mounted for axial reciprocation in said chamber, the steps which include removing the piston, fine reaming the bore of the chamber to increase its diameter approximately 0.008 inch and remove wear thereof by the piston; machining the surface of the piston to reduce its diameter to 0.678±0.0005; providing a jacket of seamless aluminum tubing; machining the inside surface of said jacket to a diameter of 0.686±0.001 of an inch; machining the outside surface of the jacket to a diameter of 0.758 to 0.7575 of an inch and hard coat anodizing said jacket to produce an anodize coating at each of the inner and outer surfaces of 0.003 of which 0.0015 is added to each of the outer and inner surfaces thereby providing an O.D. increase of 0.003 and an I.D. decrease of 0.003; in addition causing the anodizing to penetrate the surface approximately 0.0015 of an inch, coating the exterior radial surface of said piston with an anerobic adhesive which is unaffected by liquid hydrocarbon fuels; sliding said jacket over said piston and permitting said adhesive to set; grinding the exterior surface of the jacket to diameter of 0.7575±0.00005 of an inch and allowing a minimum of 0.0015 inch of hard coat anodized material to remain on the surface and to provide a clearance between this exterior surface and the inside surface of the cylinder of 0.0005 to 0.0008 inch, inserting the piston back in the cylinder.

5. The method described in claim 4 also including the steps of cutting at least two channels into the surface of reduced diameter of said piston and filling said channels with said adhesive before mounting the jacket on the piston.

* * * * *

UNITED STATES PATENT AND TRADEMARK OFFICE

CERTIFICATE OF CORRECTION

PATENT NO. : 4,748,958

DATED : June 7, 1988

INVENTOR(S) : Eugene G. Ash & Martin J. Tompkins

It is certified that error appears in the above-identified patent and that said Letters Patent is hereby corrected as shown below:

Column 4, line 53:
"0.00531" should be --0.005--

Signed and Sealed this

Seventeenth Day of January, 1989

*Attest:*

DONALD J. QUIGG

*Attesting Officer*

*Commissioner of Patents and Trademarks*